US012103799B2

(12) United States Patent
Matsuhisa et al.

(10) Patent No.: US 12,103,799 B2
(45) Date of Patent: Oct. 1, 2024

(54) WOUND BODY, CORE BODY FOR WOUND BODY, AND COMBINATION OF WOUND BODY AND SUPPORT SHAFT

(71) Applicant: Takazono Corporation, Kadoma (JP)

(72) Inventors: Yoshiki Matsuhisa, Hirakata (JP); Yoshiyuki Michihata, Hirakata (JP); Tomohiro Yoshimura, Hirakata (JP); Shinji Iwasaki, Hirakata (JP)

(73) Assignee: Takazono Corporation, Kadoma (JP)

( * ) Notice: Subject to any disclaimer, the term of this patent is extended or adjusted under 35 U.S.C. 154(b) by 308 days.

(21) Appl. No.: 17/614,170

(22) PCT Filed: Sep. 4, 2020

(86) PCT No.: PCT/JP2020/033548
§ 371 (c)(1),
(2) Date: Nov. 24, 2021

(87) PCT Pub. No.: WO2021/084909
PCT Pub. Date: May 6, 2021

(65) Prior Publication Data

US 2022/0227597 A1 Jul. 21, 2022

(30) Foreign Application Priority Data

Oct. 31, 2019 (JP) ..... 2019-198469
Oct. 31, 2019 (JP) ..... 2019-198479
(Continued)

(51) Int. Cl.
*B65H 18/02* (2006.01)
*B65H 75/10* (2006.01)
*B65H 75/30* (2006.01)

(52) U.S. Cl.
CPC ..... *B65H 18/026* (2013.01); *B65H 75/10* (2013.01); *B65H 75/30* (2013.01)

(58) Field of Classification Search
CPC ..... B65H 18/026; B65H 75/10; B65H 75/30
(Continued)

(56) References Cited

U.S. PATENT DOCUMENTS 3,106,363 A * 10/1963 Epstein ..... B65H 75/10 242/613.5
3,561,698 A * 2/1971 Steffenini ..... B65H 75/18 242/118.31
(Continued)

FOREIGN PATENT DOCUMENTS

CN 209038676 U 6/2019
JP S5137483 U 3/1976
(Continued)

OTHER PUBLICATIONS

Indonesia Office Action for Application No. P00202205127 dated Jan. 16, 2024, pp. 1-6.
(Continued)

*Primary Examiner* — William A. Rivera
(74) *Attorney, Agent, or Firm* — The Webb Law Firm

(57) ABSTRACT

Provided is a wound body formed by winding a long sheet. The wound body is supportable by a support shaft. The support shaft includes a cylindrical outer peripheral part that includes a first projection located at a proximal end and a second projection located at a distal end, and includes an inner peripheral part that includes a first recess part located at the one end and recessing outward in the radial direction and a second recess part located to extend from the one end to the other end and recessing outward in the radial direction. A recessing amount of the second recess part is smaller than that of the first recess part. The support shaft and the core body are integrally rotatable around the central axis by engagement of the first projection with the first recess part in a state where the core body is mounted on the outer periphery of the support shaft. The circumferential position
(Continued)

of the first projection around the central axis is aligned with the circumferential position of the first recess part around the central axis by engagement of the second projection with the second recess part when the core body is mounted on the outer periphery of the support shaft.

7 Claims, 5 Drawing Sheets

(30) Foreign Application Priority Data

Oct. 31, 2019 (JP) ..... 2019-198497
Apr. 28, 2020 (JP) ..... 2020-078913
Jul. 31, 2020 (JP) ..... 2020-129886

(58) Field of Classification Search
USPC ..... 242/599.4
See application file for complete search history.

(56) References Cited

U.S. PATENT DOCUMENTS 6,109,801 A * 8/2000 Mabit ..... B65H 75/18 400/248
6,425,548 B2 * 7/2002 Christensen ..... B65H 75/10 400/242
6,425,551 B1 * 7/2002 Puckett ..... B65H 75/30 242/611.2
6,923,582 B2 * 8/2005 Pomfret ..... B41J 17/24 400/242
6,997,629 B2 * 2/2006 Bungert ..... B41J 35/28 242/600
7,441,971 B2 * 10/2008 Pomfret ..... B41J 17/24 400/242
7,866,596 B2 * 1/2011 Yamada ..... B65H 75/245 242/596.7
2002/0134057 A1 9/2002 Haraguchi
2003/0080238 A1 * 5/2003 Seybold ..... B41J 15/02 242/611.2

FOREIGN PATENT DOCUMENTS

JP S5644757 Y 10/1981
JP S6145849 A 3/1986
JP 2001224663 A 8/2001
JP 2012246015 A 12/2012
JP 5499242 B2 5/2014
TW M540120 U 4/2017

OTHER PUBLICATIONS

Philippines Office Action for Application No. Invention 1/2022/550547 dated Jan. 8, 2024, pp. 1-6.
Singapore Office Action for Application No. 11202202320U dated Sep. 28, 2023, pp. 1-8.

* cited by examiner

WOUND BODY, CORE BODY FOR WOUND BODY, AND COMBINATION OF WOUND BODY AND SUPPORT SHAFT

CROSS REFERENCE TO RELATED APPLICATIONS

This application is the United States national phase of International Application No. PCT/JP2020/033548 filed Sep. 4, 2020, and claims priority to Japanese Patent Application Nos. 2019-198469 filed Oct. 31, 2019, 2019-198479 filed Oct. 31, 2019, 2019-198497 filed Oct. 31, 2019, 2020-078913 filed Apr. 28, 2020, and 2020-129886 filed Jul. 31, 2020, the disclosures of which are hereby incorporated by reference in their entirety.

BACKGROUND OF THE INVENTION

Field of the Invention

The present invention relates to a wound body formed by winding a packing material in a roll shape that is a strip-shaped sheet, a core body for a wound body that forms the wound body, and a combination of the wound body and a support shaft.

Description of Related Art

There is a medicine packing apparatus configured to pack a medicine using a packing material in the form of a strip-shaped sheet. Patent Literature 1 describes an example of a support device for the packing material included in such a medicine packing apparatus. The configuration described in Patent Literature 1 includes a mounting base (referred to as "apparatus body" in Patent Literature 1, the following descriptions in parenthesis are the same), and a support shaft (feeding drum) extending therefrom, in which the support shaft is rotatably supported by the mounding base. A core body (core cylinder) is mounted on an outer periphery of the support shaft. A packing material (packing paper) is wound around the outer periphery of the core body to form a roll-shaped wound body. Packing of a medicine can be made for the packing material sequentially drawn out from the wound body.

CITATION LIST

Patent Literature

Patent Literature 1: JP-U S56-44757 B

SUMMARY OF THE INVENTION

Technical Problem

It is an object of the present invention to provide a wound body, a core body for the wound body, and a combination of the wound body and a support shaft that have improved configurations as compared with the prior arts.

Solution to Problem

According to the present invention, there is provided a wound body formed by winding a long sheet, wherein the wound body is supportable by a support shaft, the support shaft includes a cylindrical outer peripheral part having a proximal end and a distal end, and is configured to be rotatable around a central axis of the outer peripheral part, the outer peripheral part includes a first projection located at the proximal end and projecting outward in a radial direction, and a second projection located at the distal end and projecting outward in the radial direction, in which a projecting amount of the second projection projecting outward in the radial direction with respect to the outer peripheral part is smaller than that of the first projection, the wound body includes a core body having a cylindrical shape, and the long sheet wound around an outer periphery of the core body, the core body includes a cylindrical inner peripheral part having one end and an other end, the inner peripheral part includes a first recess part located at the one end and recessing outward in the radial direction, and a second recess part located to extend from the one end to the other end and recessing outward in the radial direction, in which a recessing amount of the second recess part recessing outward in the radial direction with respect to the inner peripheral part is smaller than that of the first recess part, the core body is mountable on the outer periphery of the support shaft from the one end side of the core body, and from the distal end side of the support shaft, the support shaft and the core body are integrally rotatable around the central axis by engagement of the first projection with the first recess part in a state where the core body is mounted on the outer periphery of the support shaft, and the circumferential position of the first projection around the central axis is aligned with the circumferential position of the first recess part around the central axis by engagement of the second projection with the second recess part when the core body is mounted on the outer periphery of the support shaft.

According to the present invention, there is provided a wound body formed by winding a long sheet, the wound body including a core body having a cylindrical shape, and the long sheet wound around an outer periphery of the core body, wherein the core body includes a cylindrical inner peripheral part having one end and an other end, and the inner peripheral part includes a first recess part located at the one end and recessing outward in a radial direction, and a second recess part located to extend from the one end to the other end and recessing outward in the radial direction, in which a recessing amount of the second recess part recessing outward in the radial direction with respect to the inner peripheral part is smaller than that of the first recess part.

It can be configured such that the second recess part is formed along the entire periphery in the circumferential direction of the core body at the one end of the core body.

It can be configured such that the second recess part includes a leading part that leads the second projection, and the leading part is configured to lead the second projection to allow the circumferential position of the first projection around the central axis to be aligned with the circumferential position of the first recess part around the central axis when the core body is mounted on the outer periphery of the support shaft.

It can be configured such that the second recess part includes a guide part that guides the second projection, and the guide part is located closer to the other end of the core body than the leading part, and is configured to guide the second projection to allow the circumferential position of the first projection around the central axis to be kept in alignment with the circumferential position of the first recess part around the central axis when the core body is mounted on the outer periphery of the support shaft.

According to the present invention, there is further provided a core body for wound body that is used for a wound body formed by winding a long sheet, wherein the wound body is supportable by a support shaft, the support shaft includes a cylindrical outer peripheral part having a proximal end and a distal end, and is configured to be rotatable around a central axis of the outer peripheral part, the outer peripheral part includes a first projection located at the proximal end and projecting outward in a radial direction, and a second projection located at the distal end and projecting outward in the radial direction, in which a projecting amount of the second projection projecting outward in the radial direction with respect to the outer peripheral part is smaller than that of the first projection, the core body for the wound body has a cylindrical shape, is configured to allow the long sheet to be wound around an outer periphery of the core body, and includes a cylindrical inner peripheral part having one end and an other end, the inner peripheral part includes a first recess part located at the one end and recessing outward in the radial direction, and a second recess part located to extend from the one end to the other end and recessing outward in the radial direction, in which a recessing amount of the second recess part recessing outward in the radial direction with respect to the inner peripheral part is smaller than that of the first recess part, the core body for wound body is mountable on the outer periphery of the support shaft from the one end side of the core body for wound body, and from the distal end side of the support shaft, the support shaft and the core body for wound body are integrally rotatable around the central axis by engagement of the first projection with the first recess part in a state where the core body for wound body is mounted on the outer periphery of the support shaft, and the circumferential position of the first projection around the central axis is aligned with the circumferential position of the first recess part around the central axis by engagement of the second projection with the second recess part when the core body for wound body is mounted on the outer periphery of the support shaft.

According to the present invention, there is further provided a combination of a wound body and a support shaft, the combination including a wound body formed by winding a long sheet, and a support shaft that supports the wound body, wherein the support shaft includes a cylindrical outer peripheral part having a proximal end and a distal end, and is configured to be rotatable around a central axis of the outer peripheral part, the outer peripheral part includes a first projection located at the proximal end and projecting outward in a radial direction, and a second projection located at the distal end and projecting outward in the radial direction, in which a projecting amount of the second projection projecting outward in the radial direction with respect to the outer peripheral part is smaller than that of the first projection, the wound body includes a core body having a cylindrical shape, and the long sheet wound around an outer periphery of the core body, the core body includes a cylindrical inner peripheral part having one end and an other end, the inner peripheral part includes a first recess part located at the one end and recessing outward in the radial direction, and a second recess part located to extend from the one end to the other end and recessing outward in the radial direction, in which a recessing amount of the second recess part recessing outward in the radial direction with respect to the inner peripheral part is smaller than that of the first recess part, the core body is mountable on the outer periphery of the support shaft from the one end side of the core body, and from the distal end side of the support shaft, the support shaft and the core body are integrally rotatable around the central axis by engagement of the first projection with the first recess part in a state where the core body is mounted on the outer periphery of the support shaft, and the circumferential position of the first projection around the central axis is aligned with the circumferential position of the first recess part around the central axis by engagement of the second projection with the second recess part when the core body is mounted on the outer periphery of the support shaft.

DESCRIPTION OF THE INVENTION

The present invention will be described by way of one embodiment of a combination of a wound body 6 and a medicine packing apparatus 1. In the following description, a "proximal end side" corresponds to a left side in FIG. 2, and a "distal end side" corresponds to a right side in FIG. 2. Further, in the following description, an "axial direction" is an axial direction of a support shaft 31.

Overview of the Packing Section

Figure 1:
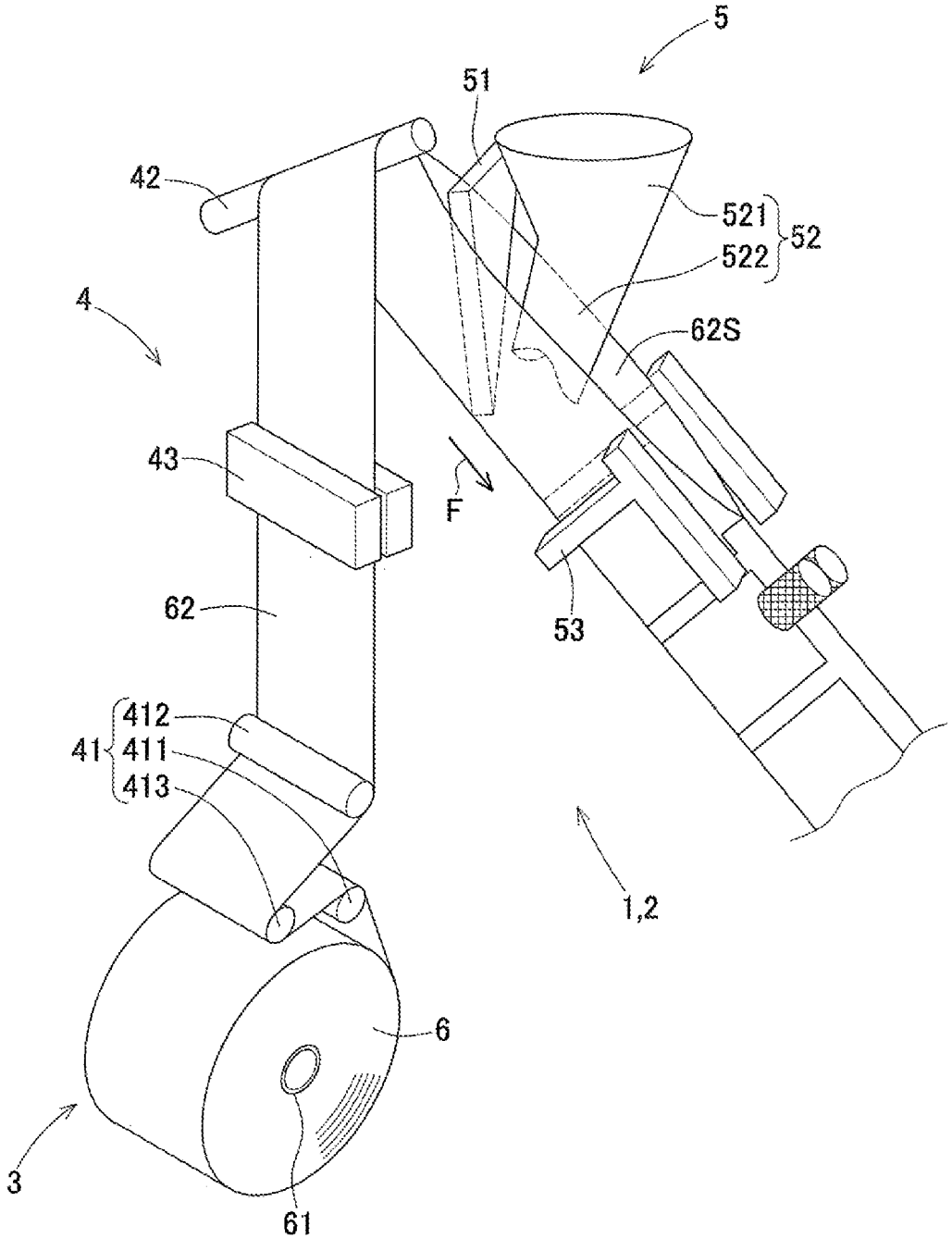
FIG. 1 is a perspective view showing a schematic configuration of a packing section in a medicine packing apparatus according to an embodiment of the present invention.

FIG. 1 schematically shows a packing section 2 that is a section for packing a medicine in a medicine packing apparatus 1. Examples of the medicine (not shown) include tablets and powders. A packing material 62 used in this medicine packing apparatus 1 is a strip-shaped and long sheet. Examples of a material of the packing material 62 include paper and resin. The packing material 62 is conveyed along its longitudinal direction (direction represented by an arrow F in FIG. 2). The packing material 62 is formed into a wound body 6 in a roll shape (packing roll) by being wound around an outer periphery of a core body 61. That is, the wound body 6 is formed by winding the packing material 62 of a long sheet shape in a roll shape. In the wound body 6, the packing material 62 is wound around the outer periphery of the core body 61 while being folded in half along a center in a width direction (short side direction). The packing material 62 is wound off from the wound body 6. The medicine packing apparatus 1 packs a medicine using the packing material 62 wound off from the wound body 6. A packing material supply section 3, a packing material conveyance section 4, and a packing body forming section 5 are located in this order from the upstream side to the downstream side in the conveyance direction of the packing material 62 in the packing section 2 of the medicine packing apparatus 1. A description will be made hereinafter on these members. A description on the packing material supply section 3 will be made later for convenience.

Packing Material Conveyance Section

The packing material conveyance section 4 conveys the packing material 62 in the longitudinal direction and supplies the same to the packing body forming part 5 on the downstream side. The packing material conveyance section 4 mainly includes a tension adjustment mechanism 41 and a folding bar 42. The tension adjustment mechanism 41 is a mechanism for adjusting the tension of the packing material 62 by stretching the packing material 62 among rollers 411 to 413, an inter-axial distance of which is changeable, so as to allow the packing material 62 to be bent backward. The tension adjustment mechanism 41 of this embodiment is formed by the combination of two fixed rollers 411 and 412 with their axial positions immovable and one dancer roller 413 with its axial position movable so as to be curved relative to the mounting base. The folding bar 42 changes the conveyance direction of the packing material 62 conveyed upward from the tension adjustment mechanism 41 to an obliquely downward direction. The packing material conveyance section 4 can include a printing section 43 for printing, for example the medicine prescription information on the surface of the packing material 62.

Packing Body Forming Section

The packing body forming section 5 is a section for supplying each dose of the medicine to the packing material 62 according to the prescription and allowing it to be packed individually by bonding the packing material 62. The packing body forming section 5 mainly includes a triangular plate 51, a hopper 52, and a packing material bonding member 53. The triangular plate 51 is a part that is located on the downstream side of the folding bar 42 in the conveyance direction and is configured to push open the packing material 62 in a state of being folded in half in the width direction so as to separate one side and the other side of the packing material 62 away from each other to allow the packing material 62 to have a V-shaped cross section as seen in the longitudinal direction. The hopper 52 has an upper part 521 and a lower part 522 that has a horizontally cross sectional area reduced compared with the upper part 521 and that is configured to be partly inserted into a space 62S having the V-shaped cross section which has been push opened by the triangular plate 51 of the packing material 62. The medicine supplied according to the prescription is supplied on the packing material 62 via the inside of the hopper 52 by a medicine supply mechanism (not shown) disposed above the hopper 52. The packing material bonding member 53 is a member configured to, for example, heat melt the packing material 62 to section the packing material 62 into individual packs. The packing body forming section 5 can further include, for example, a perforation forming member (not shown) configured to form perforations in the packing material 62 bonded by the packing material bonding member 53 for ease of cutting.

Packing Material Supply Section

The packing material supply section 3 is a section for feeding the packing material 62 to the packing material conveyance section 4 and its downstream side. The wound body 6 is arranged in the packing material supply section 3 to be rotatable in the circumferential direction. The packing material 62 is drawn out in the longitudinal direction from the wound body 6 by the rotation of the wound body 6.

Figure 2:
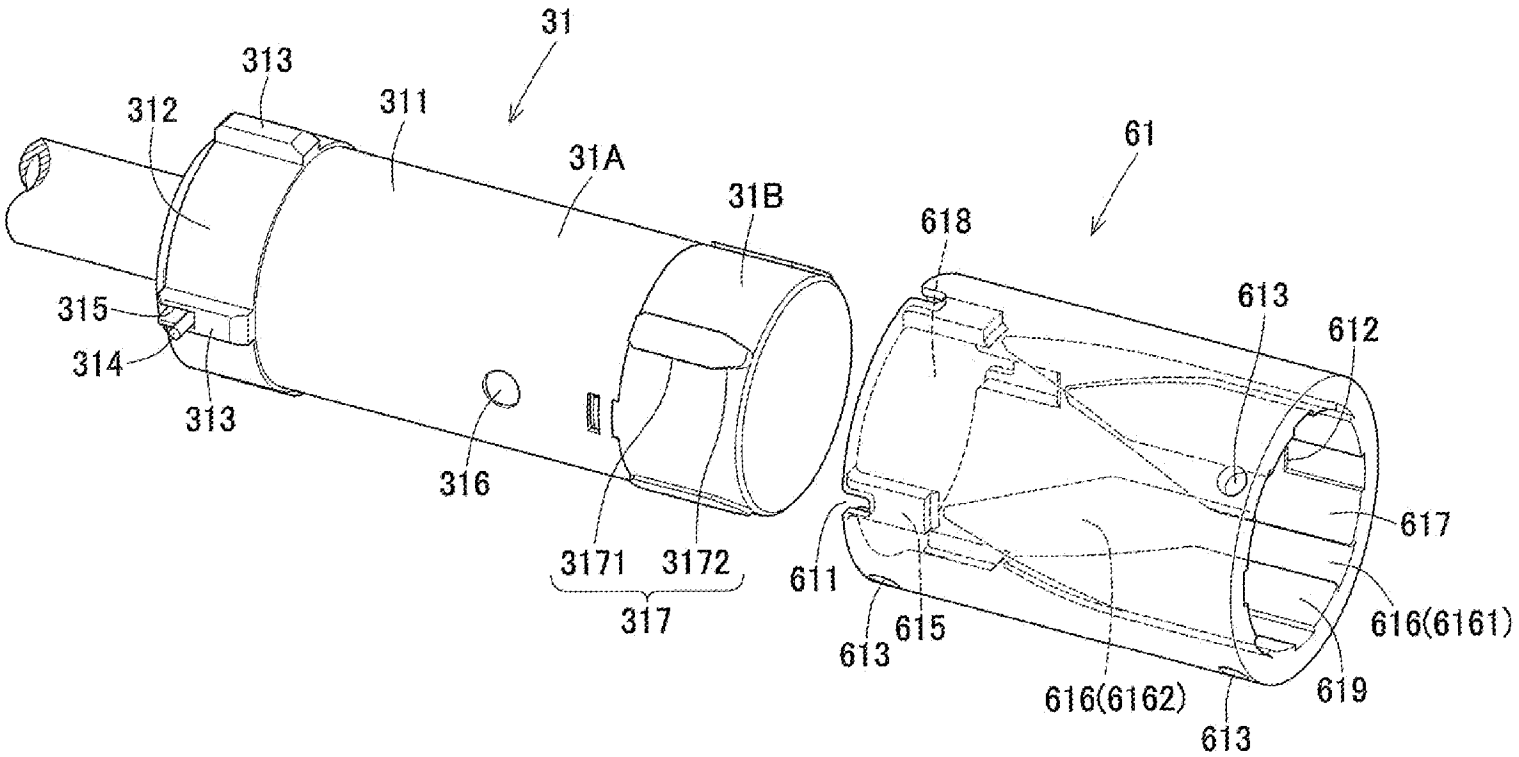
FIG. 2 is a perspective view showing a support shaft and a core body of a wound body in the packing section.

As shown in FIG. 2, the packing material supply section 3 includes a support shaft 31. The support shaft 31 extends from a non-illustrated mounting base. Apart of the packing material conveyance section 4 (i.e., the tension adjustment mechanism 41 shown in FIG. 1) is also disposed on this mounting base. The support shaft 31 has a substantially columnar shape. The support shaft 31 has an outer peripheral part having a cylindrical shape. The support shaft 31 has a proximal end (left part in FIG. 2) and a distal end (right part in FIG. 2). The proximal end of the support shaft 31 is supported by the mounting base. The support shaft 31 includes a main shaft part 311 having a constant radial dimension, and a proximal end shaft part 312 that is located closer to the proximal end than the main shaft part 311 and that has a larger radial dimension than the main shaft part 311. A step is formed between the main shaft part 311 and the proximal end shaft part 312 as shown in FIG. 2.

Figure 4:
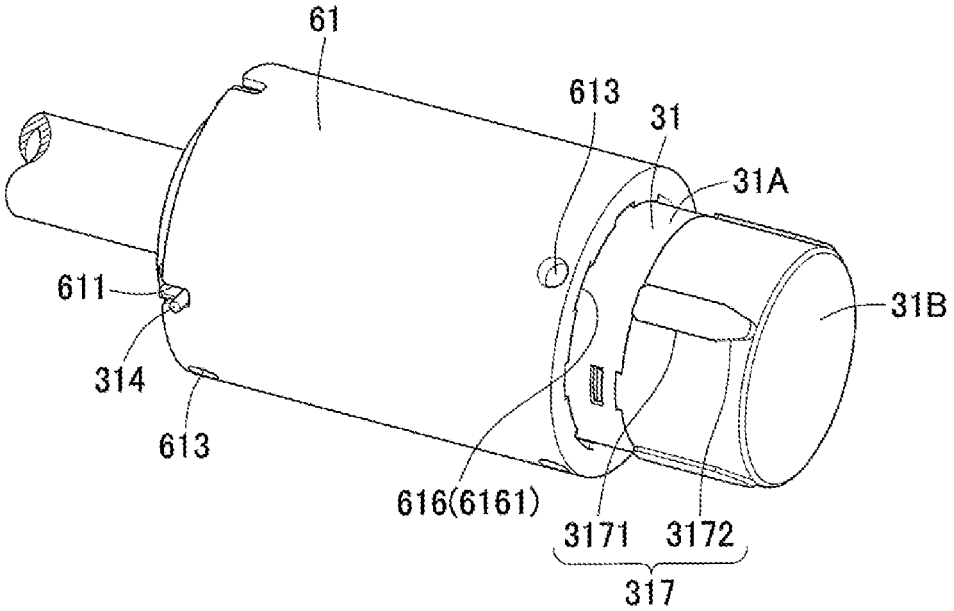
FIG. 4 is a perspective view showing the core body in a state of being mounted to the support shaft of the packing section.

The support shaft 31 is rotatably mounted to the mounting base and supports the wound body 6 (core body 61). The support shaft 31 is driven to rotate by the driving unit such as a non-illustrated stepping motor disposed inside the mounting base. The support shaft 31 is rotatable both in the direction in which the packing material 62 is wound off and the direction in which the packing material 62 is wound up. The support shaft 31 is intermittently rotated in response to the supply of the packing material 62 to the packing body forming section 5. The support shaft 31 is cantilever-supported with respect to the mounting base and has the distal end exposed to the outside. Therefore, as shown in FIG. 2, the core body 61 of the wound body 6 is disposed at a position on the exposed side of the support shaft 31, through which the axis of the support shaft 31 extends, and the wound body 6 is placed onto the support shaft 31 from the distal end toward the proximal end in the axial direction so that the wound body 6 (only the core body 61 is shown in FIG. 4) can be mounted to the support shaft 31, as shown in FIG. 4. The wound body 6 is mounted to the support shaft 31 so as not to be relatively rotatable.

The support shaft 31 of this embodiment has a length in the axial direction larger than that of the wound body 6. Therefore, as shown in FIG. 4, a part (i.e., mount assisting part 31B) of the support shaft 31 projects from the core body 61 in the mounted state (i.e., the state where the core body 61 is mounted to a support shaft main body 31A). The present invention is not necessarily limited to this configuration. The other end of the core body 61 in the mounted state, which will be later described, can be coincident with the distal end of the support shaft 31.

A part of the support shaft 31 on the distal end side (i.e., part at which a guide projection 317 is formed), which projects from the core body 61, is a mount assisting device 31B that is a separate body from the support shaft main body 31A that is a proximal end part of the support shaft 31 and is mounted to the support shaft main body 31A. This mount assisting device 31B can be used in combination with the wound body 6 of this embodiment. The mounting of the mount assisting device 31B to the support shaft main body 31A is achieved by means of a fitting engagement used in an engagement structure for mounting a distal end lid of a support shaft of an existing medicine packing apparatus (i.e., structure for mounting the mount assisting part 31B after the distal end lid is removed), or bonding to an existing support shaft (the mounting structure is not limited to these, and various mounting forms can be employed). The support shaft main body 31A has an outer peripheral part having a cylindrical shape. The mount assisting device 31B in the state of being mounted to the support shaft main body 31A functions as a mount assisting part that is a part of the support shaft 31. According to this configuration, the support shaft 31 of this embodiment can be formed by replacing, for example, a lid member provided at the distal end of a short support shaft with the mount assisting part. The support shaft 31 of this embodiment can be formed by the mount assisting part 31B to be mounted to the distal end of the support shaft main body 31A, while avoiding a significant modification to an existing medicine packing apparatus. Therefore, the combination of the wound body 6 of this embodiment and the medicine packing apparatus 1 can be realized at a reduced cost. However, when the support shaft 31 is newly produced, it may be configured to employ not a separate structure but an integrated structure in which the support shaft main body 31A and the mount assisting part 31B are inseparable from each other.

As shown in FIG. 2, a plurality of (four in this embodiment) catch projections 313 as first projections are located at the proximal end shaft part 312 of the support shaft 31. The catch projections 313 are located with a certain distance from each other (at intervals) in the circumferential direction (rotation direction). The catch projections 313 project outward in the radial direction from the outer peripheral surface of the proximal end of the support shaft 31. The catch projections 313 extend in the axial direction from the proximal end edge toward the distal end by a certain distance. Packing-material-running-out detection pins 314 having a rod shape project from some of the catch projections 313 (every other one of the catch projections 313 in the circumferential direction in this embodiment). Distal ends of the packing-material-running-out detection pins 314 are set to be located radially outward from the outer peripheral surface of the core body 61 when the wound body 6 has been mounted to the support shaft 31. The catch projections 313 provided with the packing-material-running-out detection pins 314 respectively include cutouts 315 extending therethrough in the radial direction and extending in the axial direction.

Each of the packing-material-running-out detection pins 314 is biased toward the distal end in the axial direction (right side in FIG. 4) of the support shaft 31 by a biasing force of a non-illustrated spring disposed inside the support shaft 31. When the wound body 6 with the packing material 62 wound therearound has been mounted to the support shaft 31, the packing-material-running-out detection pins 314 are pushed out to the side by the packing material 62 layered in the radial direction on the outer periphery of the core body 61 and thereby moved toward the proximal end in the axial direction against the spring urging force. The core body 61 of the wound body 6 includes cutouts 611 extending through the core body 61 in the radial direction and extending in the axial direction in the same manner as the support shaft 31 at parts which become coincide in position with the packing-material-running-out detection pins 314 when the core body 61 is mounted to the support shaft 31. The cutouts 611 are arranged to be coincident in the circumferential direction with the cutouts 315 of the support shaft 31. Therefore, the core body 61 is sometimes rotated in the circumferential direction relative to the support shaft 31 by the operator in order to align the cutouts 611 (this operation will be explained later). When the packing material 62 is unwound from the wound body 6 and has run out (that is, only the core body 61 is left), the pushing-out by the packing material 62 is eliminated, and therefore the packing-material-running-out detection pins 314 biased by the springs move toward the distal end in the axial direction and enter the cutouts 611 (see FIG. 4). A sensor or the like detects the entrance of the packing-material-running-out detection pins 314 into the cutouts 611 and thereby enabling detection of the run-out of the packing material. For example, the operation of the packing material supply section 3 can be automatically stopped based on the detection of the completion of the unwinding of the entire packing material 62 from the wound body 6.

A displacement regulating part 316 projects from an outer peripheral surface of the support shaft 31. At least one displacement regulating part 316 is disposed (two parts are disposed in this embodiment, although another part is not illustrated). When a plurality of displacement regulating parts 316 are disposed as in this embodiment, these displacement regulating parts 316 are located with a certain distance from each other (at intervals) in the circumferential direction. In this embodiment, two displacement regulating parts 316 are located at equal intervals in the circumferential direction (that is, at angular intervals of 180°). In this embodiment, the displacement regulating parts 316 are respectively located at the same positions in the circumferential direction as the positions of any ones of the catch projections 313. The displacement regulating parts 316 are projections that have, for example, a spherical or hemispherical shape, and are biased radially outward by springs disposed inside the support shaft 31 to project partly from the outer peripheral surface of the support shaft 31. The displacement regulating parts 316 are disposed to be able to be advanced from and retracted into the outer peripheral surface of the support shaft 31. The displacement regulating parts 316 respectively engage later-described step parts 612 of the core body 61. Thereby, the core body 61 can be prevented from being displaced relative to the support shaft 31 in the axial direction, and hence the wound body 6 can be securely mounted to the support shaft 31.

At least one guide projection 317 as a second projection 317 (four projections in this embodiment) are formed at the distal end of the support shaft 31 (main shaft part 311). When the plurality of guide projections 317 are formed as in this embodiment, these guide projections 317 are located with a certain distance (at intervals) from each other in the circumferential direction. The guide projections 317 project radially outward from the outer peripheral surface of the distal end of the support shaft 31. The guiding projections 317 project at positions between adjacent ones of the catch projections 313. That is, the catch projections 313 and the guiding projections 317 are alternately located as viewed in the axial direction. In this embodiment, the catch projections 313 and the guiding projections 317 are alternately located at equal intervals from each other in the circumferential direction. The projecting amount of the guide projections 317 projecting in the radially outward direction with respect to the outer peripheral part of the support shaft main body 31A is smaller than that of the catch projections 313.

As shown in FIG. 2, each of the guide projections 317 includes a main body part 3171 having a constant width, and a reducing part 3172 located on the distal end side of the main body part 3171 and having a width decreasing toward the distal end and integrally formed with the main body part 3171. The reducing part 3172 has ends in the width direction, which respectively have inclined surfaces. These inclined surfaces each are formed in a straight shape as viewed in the radial direction in this embodiment, but this is not essential. A curved line shape or any other shape can be employed. Also, these inclined surfaces are formed symmetrically with respect to the axial direction in this embodiment, but these may be formed asymmetrically.

Figure 5:
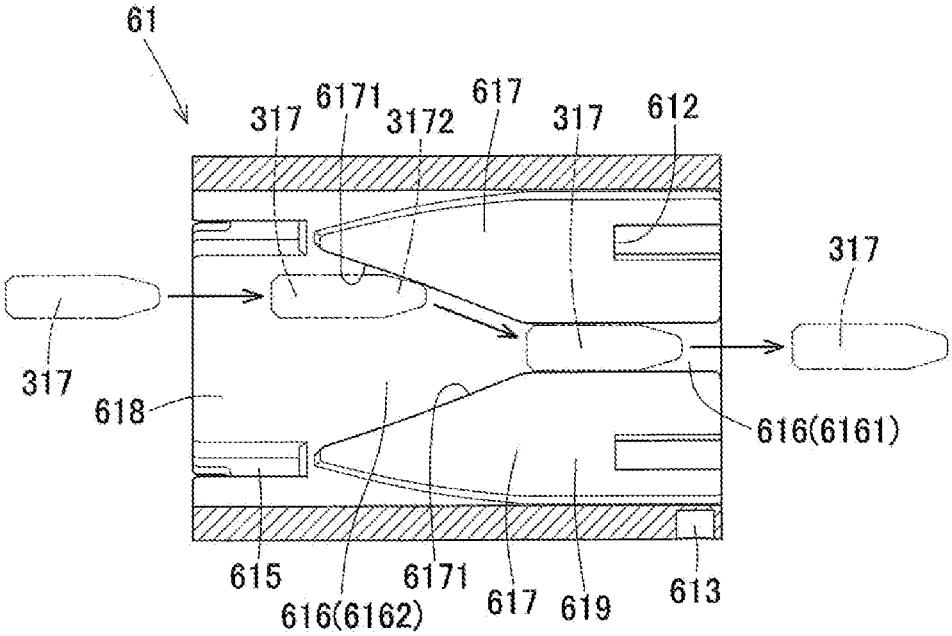
FIG. 5 is an explanatory view showing a state in which the circumferential position of the core body is aligned relative to the support shaft.

Inner peripheral surface parts 617 of the core body 61 come into contact with the guide projections 317 by the placement of the core body 61 onto the support shaft 31 so that the alignment of the circumferential position of the core body 61 with the circumferential position of the support shaft 31 around the support shaft 31 can be achieved (description on the alignment of the core body 61 will be later given). FIG. 5 shows the operation for it. In FIG. 5, the guide projections 317 (shown by two-dot chain line) are shown as moving in the axial direction relative to the core body 61 for ease of understanding. However, the actual configuration is opposite to the illustrated configuration. That is, the core body 61 actually moves in the axial direction relative to the guide projections 317. At this time, the circumferential positions of the support shaft 31 and the core body 61 are brought into alignment with each other by the rotational movement relative to each other in the circumferential direction. The support shaft 31 is kept unmoved in the circumferential direction so as to allow the core body 61 to be rotated relative to the support shaft 31, or the core body 61 is kept unmoved in the circumferential direction so as to allow the support shaft 31 to be rotated relative to the core body 61 in the circumferential direction. Or, both the support shaft 31 and the core body 61 are allowed to be respectively rotated in the circumferential direction.

The guiding projections 317 are located at positions different from those of the catch projections 313 in the axial direction. Specifically, the guiding projections 317 are located at the distal end of the support shaft 31, and the catch projections 313 are located at the proximal end of the support shaft 31. With these parts located at different positions, it is possible to bring the catch recesses 615 of the core body 61 into engagement with the catch projections 313 of the core body 61 with a time margin after the completion of the alignment operation in the circumferential direction of the core body 61. In particular, since the guiding projections 317 of this embodiment are located at the distal end of the support shaft 31, the alignment operation of the core body 61 is made not at the end of the insertion operation but at the beginning of the insertion operation. Thus, good operability in mounting the wound body 6 to the support shaft 31 is obtainable. Further, it is possible to locate a mechanism (catch recesses 615 in this embodiment) to which a rotational force is transmitted from the support shaft 31 and a mechanism (guide recess parts 616 in this embodiment) for aligning in the circumferential direction, not only at one end in the axial direction of the core body 61, but at positions dispersed in the axial direction. Therefore, it is possible to suppress the strength of one end in the axial direction of the core body 61 from being greatly lowered compared with the strength of the other end of the core body 61.

Core Body of the Wound Body

As shown in FIG. 2, the core body 61 of the wound body 6 has a cylindrical shape (circular cylindrical shape) or a tubular shape (circular tubular shape) with a circular cross section taken in the radial direction. The core body 61 has an inner peripheral part having a circular cylindrical shape. As shown in FIG. 1, the packing material 62 is wound around the outer peripheral surface of the core body 61. The outer diameter of the core body 61 is constant in the axial direction. Therefore, no step is formed on the outer peripheral surface of the core body 61 so that the packing material 62 can be wound up with no fold line formed therein. The core body 61 can be mounted on and dismounted from the outer periphery of the support shaft 31 of the packing material supply section 3 by being moved in the axial direction. The core body 61 is mounted on the outer periphery of the support shaft 31 by allowing the circumferential positions of the core body 61 and the support shaft 31 to be aligned with each other around the support shaft 31. The core body 61 has the one end and the other end. The one end is a part close to the support shaft 31 in FIG. 2, and the other end is a part far from the support shaft 31 in FIG. 2. The core body 61 is mounted to the support shaft 31 from the one end side, which is a regular direction (mounting direction). At the time of mounting, the core body 61 is moved in the axial direction from the distal end toward the proximal end of the support shaft 31. The core body 61 has the cutouts 611 at the proximal end in the direction in which the support shaft 31 is mounted (regular mounting direction). With the core body 61 mounted to the support shaft 31, the cutouts 611 are located at the positions corresponding to the packing-material-running-out detection pins 314 projecting outward in the radial direction from the support shaft 31. The cutouts 611 extend through the core body 61 in the radial direction and define spaces opening at the distal end edge of the core body 61. Each of the packing-material-running-out detection pins 314 is movable in the axial direction within each corresponding one of the spaces. This movement is done after the packing material 62 has been wound off from the wound body 6 and no packing material 62 is left on the wound body 6 (FIG. 4 shows the state after the movement). Meanwhile, the cutouts 611 can be used as leads identified in a visual sense or a tactile sense.

As shown in FIG. 2, step parts 612 are formed in the inner peripheral part of the core body 61 on the distal end side of the core body 61. A plurality of the step parts 612 (four in this embodiment) are located intermittently in the circumferential direction. The displacement regulating parts 316 projecting from the support shaft 31 engage the step parts 612. Therefore, it is possible to prevent the core body 61 from being displaced relative to the support shaft 31 in the axial direction, and securely mount the wound body 6 to the support shaft 31. On the other hand, since the displacement regulating parts 316 are spring biased, the core body 61 moves relative to the support shaft 31 by moving the core body 61 in the axial direction by a force exceeding the biasing force of the springs, for example, when the core body 61 is pulled out of the support shaft 31. Therefore, the operation for pulling the core body 61 out of the support shaft 31 can be made without hindrance.

The core body 61 includes a plurality of magnet retention parts 613 that retain permanent magnet combined to correspond to a magnetic detecting part such as a magnetic sensor that is included in the packing material supply section 3 for identifying the wound body 6. Permanent magnets are arranged at selected given number of the magnet retention parts 613 among all the magnet retention parts 613 (the magnet retention parts 613 without permanent magnets are shown in Figures). The identification of the wound body 6 specifically means the identification of a material of the packing material 62. The identification is made by the magnetic detecting part that detects the number of the magnet retention parts 613 at which the permanent magnets are arranged, the polarity of the permanent magnet or the strength of the magnetic force of the permanent magnets. The magnet retention parts 613 are not needed in a medicine packing apparatus, in which the identification of the wound body 6 is made by any other means than the magnet, for example, electromagnetic detection by using, for example, IC chips such as the RFID tag enabling the wireless identification, or optical detection by the two-dimensional code, or in a medicine packaging apparatus, in which the magnetic detecting part is removed or disabled by the modification.

Figure 3:
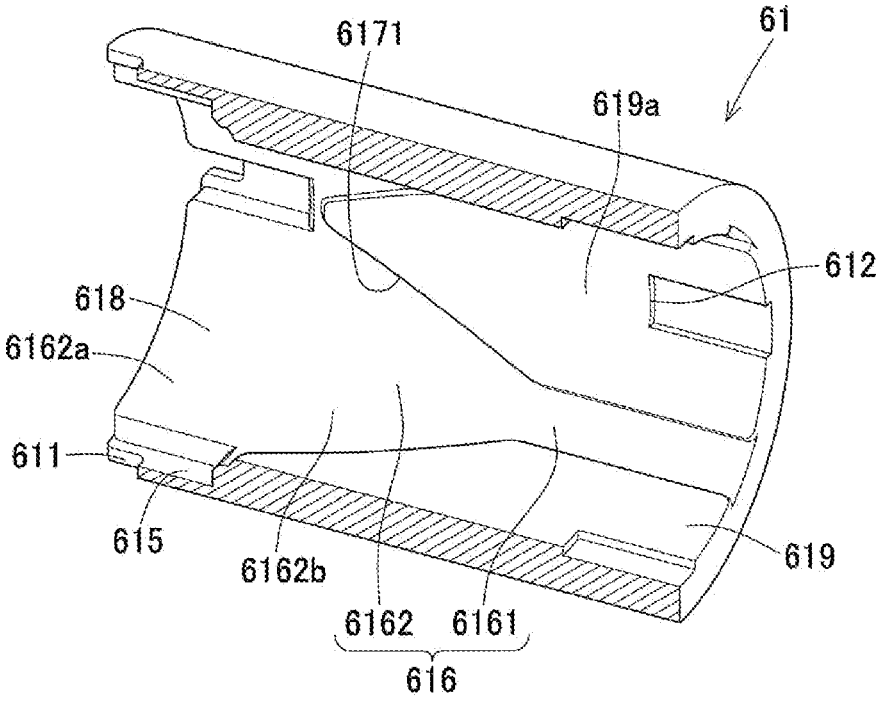
FIG. 3 is a cross sectional perspective view along an axis of the core body showing a half of the core body.

The inner periphery of the core body 61 includes the catch recess parts 615 as the first recess parts, guide recess parts 616 as the second recess parts, and the inner peripheral surface parts 617. A plurality of groups each of which includes the catch recess part 615, the guide recess part 616, and the inner peripheral surface part 617 are disposed in the circumferential direction. These groups can be located at equal intervals in the circumferential direction. In this embodiment, four groups of these parts 615 to 617 are located at equal intervals in the circumferential direction. However, it is possible to dispose only one group, or dispose a plurality of groups at unequal intervals. These parts 615 to 617 are located asymmetrically in the axial direction, as shown in FIG. 2 and FIG. 3.

The catch recess parts 615 are located in the inner periphery on the one end side of the core body 61. The catch recess parts 615 in the state where the core body 61 is mounted to the support shaft 31 engages the catch projection 313 of the support shaft 31 to enable transmission of a rotational force in the circumferential direction between the core body 61 and the support shaft 31. That is, in the state where the core body 61 is mounted on the outer periphery of the support shaft main body 31A, the support shaft main body 31A and the core body 61 are integrally rotatable around the central axis of the outer peripheral part of the support shaft main body 31A by the engagement between the catch projections 313 and the catch recess parts 615. The number of the catch recess parts 615 is the same as the number of the catch projections 313 of the support shaft 31. The number of the groups each including the guide recess part 616 and the inner peripheral surface part 617 is the same as the number of the guide projections 317 of the support shaft 31. However, the number of the catch recess parts 615 can be larger than the number of the catch projections 313 of the support shaft 31. The number of groups each including the guide recess part 616 and the inner peripheral surface part 617 can be larger than the number of the guide projections 317.

The guide recess parts 616 are located in the inner periphery of the core body 61 to extend from the one end side to the other end side in the axial direction. The guide recess parts 616 have an inner diameter larger than the outer diameter of the support shaft 31. The recessing amount of the guide recess parts 616 recessing outward in the radial direction with respect to the inner peripheral part of the core body 61 (more specifically, the inner peripheral surface, still more specifically, the inner peripheral surface of the inner peripheral surface part 617 or the large thickness part 619) is smaller than the recessing amount of the catch recess parts 615. Therefore, it is possible to prevent deterioration of the strength of the core body 61 due to the recesses. The guide recess parts 616 are formed along the entire periphery in the circumferential direction of the core body 61 at the one end of the core body 61 (part 6162*a* shown in FIG. 3). Therefore, when the core body 61 is placed onto the mount assisting part 31B, it is not necessary to align the circumferential position of the core body 61 with the circumferential position of the mount assisting part 31B around the central axis. Thus, easy operation can be realized. The guide recess parts 616 engage the guide projections 317 when the core body 61 is mounted to the support shaft 31, thereby aligning the circumferential position of the core body 61 with the circumferential position of the support shaft 31 around the support shaft 31. That is, when the core body 61 is mounted on the outer periphery of the support shaft main body 31A, the guide projections 317 engage the guide recess parts 616, thereby aligning the circumferential positions of the guiding projections 317 with the circumferential positions of the guide recess parts 616 around the central axis of the outer peripheral part of the support shaft main body 31A. Each of the guide recess parts 616 includes positioning part 6161 that is positioned on the other end side, has a constant width (dimension in the circumferential direction) and extends in the axial direction, and a leading part 6162 that is continuous with the one end side of the positioning part 6161, and has a width (dimension in the circumferential direction) increasing as it advances toward the one end in the axial direction. The width of the positioning part 6161 is substantially the same as the width of the guiding projections 317. Specifically, the width of the positioning part 6161 is larger than (slightly larger than) the width of the guiding projections 317 to the extent which allows for the movement of the guiding projections 317 through the positioning part 6161 in the axial direction of the core body 61.

A portion 6162*b* of the leading part 6162 which is overlapped with the inner peripheral surface part 617 in the axial direction has a dimension in the circumferential direction decreasing as it advances from the one end toward the other end, so that the core body 61 is moved in the circumferential direction according to this decrease (see FIG. 5; FIG. 5 shows the opposite relationship between the core body 61 and the guiding projections 317 regarding the movability and the immovability to the actual relationship). The catch recess parts 615 of the core body 61 coincide with the catch projections 313 of the support shaft 31. Thus, the core body 61 is rotated relative to the support shaft 31 to have their circumferential positions aligned with each other.

A portion 6162*a* (see FIG. 3) of the leading part 6162 which is not overlapped with the inner peripheral surface part 617 in the axial direction does not produce an effect of moving the core body 61 in the circumferential direction by the contact with the guiding projections 317. The part 6162*a* produces an effect of facilitating the mounting of the core body 61 to the support shaft 31. The leading part 6162 has an inner diameter larger than the outer diameter of the support shaft 31, and is exposed at the one end in the axial direction of the core body 61. In this embodiment, the leading part 6162 is exposed along the entire periphery in the circumferential direction. That is, the inner diameter of the one end in the axial direction of the core body 61 has a clearance relative e to ("loose" relationship with) the outer diameter of the support shaft 31. Therefore, the insertion of the wound body 6 (core body 61) onto the support shaft 31 can be easily made compared with the configuration lacking such a clearance. Since the wound body 6 having the core body 61 with the packing material 62 wound therearound is heavy (in particular, a new wound body 6 is heavy because of no consumption of the packing material 62), the facilitation of the insertion is a great advantage for the user of the medicine packing apparatus 1. This effect is also an effect produced by the later-described small thickness parts 618.

The portion 6162*a* of the leading part 6162 which is not overlapped with the inner peripheral surface part 617 in the axial direction can be said as "free area" for allowing for the rotation of the core body 61 without limitation. The positioning part 6161 can be said as "limitation area" in which the rotation of the core body 61 is limited to the extent which makes the rotation substantially impossible (specifically, a clearance in the circumferential direction exists to the extent which allows for positional displacement of the guide recess parts 616 of the core body 61 in the axial direction relative to the guiding projections 317. The portion 6162*b* of the leading part 6162 which is overlapped with the inner peripheral surface part 617 in the axial direction can be said as "transition area" in which the range in which the core body 61 is rotatable is smaller in the other end side in the axial direction than that in the one end side. The free area, the transition area, and the limitation area of the guide recess part 616 are continued in this order from the one end side to the other end side in the axial direction.

The inner peripheral surface parts 617 are parts adjacent to the guide recess parts 616 in the circumferential direction. The inner peripheral surface parts 617 have a larger thickness (i.e., a larger dimension in the radial direction) than that of the guide recess parts 616. Each of the inner peripheral surface parts 617 is located on the inner periphery of the core body 61 to extend from the other end toward the one end in the axial direction of the core body 61 and does not reach the edge on the one end side of the core body 61 in the axial direction and that has a leading edge located between the center in the axial direction and the edge on the one end side in the axial direction of the core body 61. In this embodiment, the leading edge of each of the inner peripheral surface parts 617 is located at a position adjacent to the other end side of the corresponding catch recess 615 in the axial direction. A leading edge portion of each of the inner peripheral surface part 617 has a dimension in the circumferential direction decreasing as it advances from the other end side toward the one end side, which forms a reversed shape to the shape of the leading part 6162. Thus, each of the inner peripheral surface parts 617 has a shape asymmetrical in the axial direction.

The surface of each of the inner peripheral surface parts 617 is a curved face having a constant curvature in the circumferential direction. The curvature of the surface in the circumferential direction of each of the inner peripheral surface parts 617 is the same (substantially the same) as the curvature in the circumferential direction of the outer peripheral surface of the support shaft 31. Since the surface of each of the inner peripheral surface parts 617 is a curved face having a wide area, each of the inner peripheral surface parts 617 comes into surface contact with the outer peripheral surface of the support shaft 31 when the core body 61 is mounted to the support shaft 31. For example, in the configuration in which projections are located on the inner peripheral surface of the support shaft to extend in the axial direction, the core body comes into line contact with the outer peripheral surface of the support shaft. In this arrangement, deformation (distortion) to the main part of the core body that is a floating state relative to the supporting shaft may occur due to "winding and tightening" which will be described later. Contrarily to this, in this embodiment, since the surface of each of the inner peripheral surface parts 617 comes into surface contact with the outer peripheral surface of the support shaft 31, it is possible to reduce the possibility of causing the aforementioned deformation (distortion) to the core body 61.

Since the inner peripheral surface parts 617 have a large thickness and the guide recess parts 616 have a small thickness, a step is formed between each of the inner peripheral surface parts 617 and each of the guide recess parts 616. That is, the edges in the circumferential direction of the positioning part 6161 of each of the guide recess parts 616 and the leading parts 6162 are defined by each of the inner peripheral surface parts 617. Each of the inner peripheral surface parts 617 has core-body-side inclined faces 6171 defining the edges in the width direction (circumferential direction) of the leading parts 6162 of the guide recess parts 616 (see FIG. 4 and FIG. 5).

When the core body 61 including the catch recess parts 615, the guide recess parts 616, and the inner peripheral surface parts 617 is to be mounted to the support shaft 31 from the one end side, the leading parts 6162 of the core body 61 are first positioned to face the guiding projections 317 of the support shaft 31. When the core body 61 is further moved in the axial direction, the positions of the positioning parts 6161 of the core body 61 are changed relative to the guiding projections 317 (see position changes shown by the arrows in FIG. 5).

The positioning parts 6161 are also guide parts for guiding the guiding projections 317. Each of the positioning parts 6161 as the guide parts is located at the other end, is continuous with the leading part 6162, and is configured to guide the guiding projection 317 so as to allow the circumferential positions of the catch projections 313 and the catch recess parts 615 around the central axis of the outer periphery part of the support shaft main body 31A to be maintained in alignment with each other when the core body 61 is mounted on the outer periphery of the support shaft main body 31A. Thereby, when the core body 61 is mounted to the support shaft main body 31A, it is not necessary to intentionally maintain the state where the circumferential position of the support shaft main body 31A is aligned with the circumferential position of the core body 61 around the central axis. Thus, this allows for ease of the alignment operation.

The leading part 6162 has a width (dimension in the circumferential direction) decreasing as it advances from the one end toward the other end of the core body 61. Thereby, when the core body 61 is mounted on the outer periphery of the support shaft main body 31A, the leading part 6162 is leads the guiding projection 317 to allow the circumferential positions of the catch projections 313 and the catch recess parts 615 around the central axis of the outer periphery part of the support shaft main body 31A to be aligned with each other. According to this configuration, it is not necessary to intentionally align the circumferential position of the support shaft main body 31A and the circumferential position of the core body 61 with each other around the central axis. This allows for ease of the operation.

When the guiding projection 317 is located at an end in the circumferential direction of the corresponding leading part 6162, the edge of the leading part 6162, that is, the core-body-side inclined face 6171 contacts the guiding projection 317. Thereby, the guiding projection 317 is led to a position at which it coincides with the positioning part 6161 of the core body 61. When the core body 61 is moved further in the axial direction, a portion of the guiding projection 317 and a portion of the catch recess 615 come into engagement with each other, while the guiding projection 317 and the positioning part 6161 come into engagement with each other. When the core body 61 is moved further in the axial direction, the positioning part 6161 of the core body 61 is released from the guiding projections 317 and thereby the catch projections 313 completely engage the catch recess parts 615 to finally come into a state as shown in FIG. 4.

The edge (core-body-side inclined face 6171) of the leading part 6162 sometimes comes into contact with the inclined face of the reducing part 3172 of the guiding projection 317 (see FIG. 5). Since the core-body-side inclined face 6171 that is the edge of the leading part 6162 has substantially the same degree of inclination as that of the inclined face of the reducing part 3172 of the guiding projection 317. Therefore, the contact therebetween can be smoothly performed.

According to the core body 61 of this embodiment, the mounting of the core body 61 to the support shaft 31 can be easily performed by the guide recess parts 616, and the strength of the core body 61 can be secured by the inner peripheral surface parts 617.

The core body 61 includes small thickness parts 618 and large thickness parts 619. The small thickness parts 618 are disposed in the inner periphery of the core body 61 on the one end side in the axial direction. The small thickness parts 618 engage a proximal end shaft part 312 of the support shaft 31 in the state where the core body 61 is mounted to the support shaft 31. The large thickness parts 619 are disposed in the inner periphery of the core body 61 on the other end side in the axial direction, and engage the main shaft part 311 of the support shaft 31 in the state where the core body 61 is mounted to the support shaft 31. The large thickness parts 619 have a thickness larger than the small thickness parts 618. The small thickness parts 618 correspond to the aforementioned guide recess parts 616, and the large thickness parts 619 correspond to the aforementioned inner peripheral surface parts 617. The small thickness parts 618 are formed for the purpose different from that of the guide recess parts 616, while the forming areas of the small thickness parts 618 in the inner periphery of the core body 61 are the same as those of the guide recesses 616. The forming areas of the small thickness parts 618 and the guide recess parts 616 can be differentiated from each other. The large thickness parts 619 are formed for the purpose different from that of the aforementioned inner peripheral surface parts 617, while the forming areas of the large thickness parts 619 in the inner periphery of the core body 61 are the same as that of the inner peripheral surface parts 617. The forming areas of the large thickness parts 619 and the inner peripheral surface parts 617 can be differentiated from each other.

A phenomenon called "winding and tightening" sometimes occurs due to the stress (i.e., force causing shrinkage in the longitudinal direction) remaining in the packing material after the winding operation in the manufacturing the wound body, the surrounding temperature or humidity. This "winding and tightening" causes a compressive force in the radial direction of the core body. There is a case where this compressive force causes a small thickness portion to be deformed inwardly in the radial direction, and hence causes the outer periphery of the core body to be distorted, as a result of which feeding out of the packing material becomes uneven, and packing of a medicine becomes unstable.

According to the core body 61 of this embodiment, the small thickness parts 618 engage the proximal end shaft part 312, and the large thickness parts 619 engage the main shaft part 311 of the support shaft 31. The outer diameter of the proximal end shaft part 312 of the support shaft 31 is larger than the outer diameter of the main shaft part 311. The outer diameter of the proximal end shaft part 312 of the support shaft 31 is the same as the inner diameter of the small thickness parts 618 of the core body 61 to the extent which allows for insertion. Further, the outer diameter of the main shaft part 311 of the support shaft 31 is the same as the inner diameter of the large thickness parts 619 to the extent which allows for insertion. A clearance between the support shaft 31 and the core body 61 can be suppressed by the engagement of the core body 61 with the support shaft 31. Therefore, it is possible to eliminate a clearance which may permit distortion of the core body 61 of such a degree as to affect on the feeding out of the packing material 62. Thus, the core body 61 physically supported by the support shaft 31 can cope with a compressive force of the winding and tightening, which is caused in the wound packing material 62. In particular, the large thickness parts 619 occupy a large area in the circumferential direction compared with the small thickness parts 618, in an area 619*a* closer to the other end than the center in the axial direction of the core body 61. Therefore, the area 619*a* acts greatly in coping with the compressive force of the winding and tightening.

Recycling of the Used Core Body

The core body 61 is formed of, for example, a hard resin. Accordingly, the core body 61 can be repeatedly used many times by recycling the core body 61 after the core body 61 is used up. This can contribute to, for example, saving, for example, petroleum resources. The recycling is realized by winding a new packing material 62 around the used core body 61 recovered from the user of the medicine packing apparatus 1. The winding of the new packing material 62 around the core body 61 to be recycled makes it possible to manufacture a new wound body 6. For the smooth recovery, it may be configured such that the wound body 6 is delivered to the user while the core body 61 included in the wound body 6 is rented to the user, and the user returns the core body 61 thereafter, which promotes the user to return the core body 61.

The winding of a new packing material 62 around the used core body 61 can be made by, for example, a method in which the new packing material 62 is wound around a separate core body (e.g., paper cylinder) 63 having an inner diameter larger than the outer diameter of the core body 61, and a thus previously produced packing material roll (replacement wound body) is attached to the used core body 61. When employing this method, it is possible to adjust the difference in dimension between the outer diameter of the used core body 61 and the inner diameter of the separate core body by interposing a spacer such as a rubber ring between the used core body 61 and the separate core body.

The production of the new wound body 6 can be made by a supplier of the wound body 6, or the works relating to the production can be made by the user according to the instructions sent from the supplier of the wound body 6 to the user. In the latter case, the used core body 61 is not recovered but remains possessed at the user's site. The instructions from the supplier of the wound body 6 to the user may be either explicitly or implicitly made. Examples of the latter implicit instructions include simply assigning the replacement wound body to the user.

Problems in Prior Arts and Effects of this Embodiment on the Problem

It is conceivable to form the core body with an inner diameter larger than the outer diameter of the support shaft in order to facilitate the placement operation of the core body onto the support shaft of the medicine packing apparatus in the prior arts, that is, to form the core body with a large clearance. However, increase in the inner diameter of the core body with the outer diameter of the core body remaining unchanged causes the core body to have a thinned wall, which results in lowering in the strength of the core body. In order to deal with this, according to this embodiment, it is possible to suppress lowering in the strength of the core body 61 while facilitating the mounting of the core body 61 to the support shaft 31.

A conventional core body has a small thickness at an end in the axial direction in order to form a step to prevent the core body from being pulled out of the support shaft of the medicine packing apparatus (see Figures of JP-U-56-44757 B, for example). However, a phenomenon called "winding and tightening" sometimes occurs due to the stress (i.e., force causing shrinkage in the longitudinal direction) remaining in the packing material after the winding operation in the manufacturing the wound body, the surrounding temperature or humidity. This "winding and tightening" applies a compressive force to the core body in the radial direction. There is a case where this compressive force causes a small thickness portion to be deformed inwardly in the radial direction, and hence causes the outer periphery of the core body to have a distorted shape. This sometimes causes uneven feeding of the packing material and unstable packing of the medicine. Contrarily to this, this embodiment enables stable packing of the medicine.

It is also conceivable to use a wound body having a new configuration while modifying a support shaft of an existing medicine packing apparatus in order to facilitate the placement operation of the wound body onto the support shaft of such a conventional medicine packing apparatus. However, a demand exists to avoid a significant modification to the support shaft of the existing medicine packing apparatus. Contrarily to this, this embodiment makes it possible to facilitate the mounting operation of the wound body 6 to the support shaft 31 without a significant modification to a support shaft of an existing medicine packing apparatus.

Possibility to Modify the Embodiment

Although the description was made on the one embodiment of the present invention, the present invention is not necessarily limited to the above embodiment and can be subjected to various modifications within the gist of the present invention.

REFERENCE SIGNS LIST

1: Medicine packing apparatus
2: Packing section
3: Packing material supply section
31: Support shaft
31A: Support shaft body
31B: Mount assisting part (mount assisting device)
311: Main shaft part
312: Proximal end shaft part
313: Catch projection, first projection
317: Guiding projection, second projection
4: Packing material conveyance section
5: Packing body forming section
6: Wound body
61: Core body
615: Catch recess, first recess part
616: Guide recess part, second recess part
6161: Positioning part
6162: Leading part
617: Inner peripheral surface part
618: Small thickness part
619: Large thickness part
62: Packing material

The invention claimed is:

1. A wound body formed by winding a long sheet, wherein
the wound body is supportable by a support shaft,
the support shaft comprises a cylindrical outer peripheral part having a proximal end and a distal end, and is configured to be rotatable around a central axis of the outer peripheral part,
the outer peripheral part comprises a 1st projection located at the proximal end and projecting outward in a radial direction, and a 2nd projection located at the distal end and projecting outward in the radial direction, in which a projecting amount of the 2nd projection projecting outward in the radial direction with respect to the outer peripheral part is smaller than that of the 1 st projection,
the wound body comprises a core body having a cylindrical shape, and the long sheet wound around an outer periphery of the core body,
the core body comprises a cylindrical inner peripheral part having one end and an other end,
the inner peripheral part comprises a 1st recess part located at the one end and recessing outward in the radial direction, and a 2nd recess part located to extend from the one end to the other end and recessing outward in the radial direction, in which a recessing amount of the 2nd recess part recessing outward in the radial direction with respect to the inner peripheral part is smaller than that of the 1st recess part,
the core body is mountable on the outer periphery of the support shaft from the one end side of the core body, and from the distal end side of the support shaft,
the support shaft and the core body are integrally rotatable around the central axis by engagement of the 1st projection with the 1st recess part in a state where the core body is mounted on the outer periphery of the support shaft, and
the circumferential position of the 1st projection around the central axis is aligned with the circumferential position of the 1st recess part around the central axis by engagement of the 2nd projection with the 2nd recess part when the core body is mounted on the outer periphery of the support shaft.

2. The wound body according to claim 1, wherein the 2nd recess part is formed along the entire periphery in the circumferential direction of the core body at the one end of the core body.

3. The wound body according to claim 1, wherein
the 2nd recess part comprises a leading part that leads the 2nd projection, and
the leading part is configured to lead the 2nd projection to allow the circumferential position of the 1st projection around the central axis to be aligned with the circumferential position of the 1st recess part around the central axis when the core body is mounted on the outer periphery of the support shaft.

4. The wound body according to claim 3, wherein
the 2nd recess part comprises a guide part that guides the 2nd projection, and
the guide part is located closer to the other end of the core body than the leading part, and is configured to guide the 2nd projection to allow the circumferential position of the 1st projection around the central axis to be kept in alignment with the circumferential position of the 1st recess part around the central axis when the core body is mounted on the outer periphery of the support shaft.

5. A wound body formed by winding a long sheet, comprising:
a core body having a cylindrical shape, and the long sheet wound around an outer periphery of the core body, wherein
the core body comprises a cylindrical inner peripheral part having one end and another end,
the inner peripheral part comprises a 1st recess part located at the one end and recessing outward in a radial direction, and a 2nd recess part located to extend from the one end to the other end and recessing outward in the radial direction, in which a recessing amount of the 2nd recess part recessing outward in the radial direction with respect to the inner peripheral part is smaller than that of the 1st recess part,
the core body is mountable on the outer periphery of the rotatable support shaft from the one end side of the core body,
the core body is configured such that, with the core body mounted on the outer periphery of the support shaft, the core body is rotatable integrally with the support shaft by engagement of the 1st recess part with the 1st projection that is located at a proximal end of the support shaft, and
such that, when the core body is mounted on the outer periphery of the support shaft, the circumferential position of the 1st projection is aligned with the circumferential position of the 1 st recess part around the support shaft by engagement of the 2nd recess part with the 2nd projection that is located at a distal end of the support shaft.

6. A core body for wound body that is used for a wound body formed by winding a long sheet, wherein the wound body is supportable by a support shaft, the support shaft comprises a cylindrical outer peripheral part having a proximal end and a distal end, and is configured to be rotatable around a central axis of the outer peripheral part, the outer peripheral part comprises a 1st projection located at the proximal end and projecting outward in a radial direction, and a 2nd projection located at the distal end and projecting outward in the radial direction, in which a projecting amount of the 2nd projection projecting outward in the radial direction with respect to the outer peripheral part is smaller than that of the 1 st projection, the core body for the wound body has a cylindrical shape, is configured to allow the long sheet to be wound around an outer periphery of the core body, and comprises a cylindrical inner peripheral part having one end and an other end, the inner peripheral part comprises a 1st recess part located at the one end and recessing outward in the radial direction, and a 2nd recess part located to extend from the one end to the other end and recessing outward in the radial direction, in which a recessing amount of the 2nd recess part recessing outward in the radial direction with respect to the inner peripheral part is smaller than that of the 1st recess part, the core body for wound body is mountable on the outer periphery of the support shaft from the one end side of the core body for wound body, and from the distal end side of the support shaft, the support shaft and the core body for wound body are integrally rotatable around the central axis by engagement of the 1st projection with the 1st recess part in a state where the core body for wound body is mounted on the outer periphery of the support shaft, and the circumferential position of the 1st projection around the central axis is aligned with the circumferential position of the 1st recess part around the central axis by engagement of the 2nd projection with the 2nd recess part when the core body for wound body is mounted on the outer periphery of the support shaft.

7. A combination of a wound body and a support shaft, the combination comprising the wound body formed by winding a long sheet, and the support shaft that supports the wound body, wherein the support shaft comprises a cylindrical outer peripheral part having a proximal end and a distal end, and is configured to be rotatable around a central axis of the outer peripheral part, the outer peripheral part comprises a 1st projection located at the proximal end and projecting outward in a radial direction, and a 2nd projection located at the distal end and projecting outward in the radial direction, in which a projecting amount of the 2nd projection projecting outward in the radial direction with respect to the outer peripheral part is smaller than that of the 1st projection, the wound body comprises a core body having a cylindrical shape, and the long sheet wound around an outer periphery of the core body, the core body comprises a cylindrical inner peripheral part having one end and an other end, the inner peripheral part comprises a 1st recess part located at the one end and recessing outward in the radial direction, and a 2nd recess part located to extend from the one end to the other end and recessing outward in the radial direction, in which a recessing amount of the 2nd recess part recessing outward in the radial direction with respect to the inner peripheral part is smaller than that of the 1st recess part, the core body is mountable on the outer periphery of the support shaft from the one end side of the core body, and from the distal end side of the support shaft, the support shaft and the core body are integrally rotatable around the central axis by engagement of the 1st projection with the 1st recess part in a state where the core body is mounted on the outer periphery of the support shaft, and the circumferential position of the 1st projection around the central axis is aligned with the circumferential position of the 1st recess part around the central axis by engagement of the 2nd projection with the 2nd recess part when the core body is mounted on the outer periphery of the support shaft.

* * * * *